US007602345B2

(12) United States Patent
Chominski

(10) Patent No.: US 7,602,345 B2
(45) Date of Patent: Oct. 13, 2009

(54) MULTI-BAND SMALL APERTURE ANTENNA

(75) Inventor: Michael Chominski, Carlsbad, CA (US)

(73) Assignee: Free Alliance SDN BHD, Sri Hartamas (MY)

( * ) Notice: Subject to any disclaimer, the term of this patent is extended or adjusted under 35 U.S.C. 154(b) by 416 days.

(21) Appl. No.: 11/514,591

(22) Filed: Sep. 1, 2006

(65) Prior Publication Data

US 2008/0055173 A1 Mar. 6, 2008

(51) Int. Cl.
*H01Q 7/00* (2006.01)

(52) U.S. Cl. ..... 343/741; 343/748

(58) Field of Classification Search ..... 343/741–743, 343/748, 866, 867

See application file for complete search history.

(56) References Cited

U.S. PATENT DOCUMENTS

| | | | | |
|---|---|---|---|---|
| 3,641,576 | A * | 2/1972 | Farbanish | 343/743 |
| 6,795,714 | B1 | 9/2004 | Fickenscher et al. | |
| 2006/0028332 | A1 | 2/2006 | Miller | |
| 2008/0036678 | A1 * | 2/2008 | Park et al. | 343/866 |

* cited by examiner

*Primary Examiner*—Michael C Wimer
(74) *Attorney, Agent, or Firm*—Salie Ackerman LLC; Stephen B. Ackerman

(57) ABSTRACT

Described is the transformation of a mono-band antenna into a or multi-band antenna by adding matching circuits, in either serial or parallel fashion, to a mono-band antenna. The matching circuits contain reactive elements such as inductors and capacitors which create impedance matching for two or more frequency bands. These multi-band loop antennas can be used for frequencies extending from a few megahertz to several hundred megahertz. The method of tuning such multi-band antennas is also described.

25 Claims, 7 Drawing Sheets

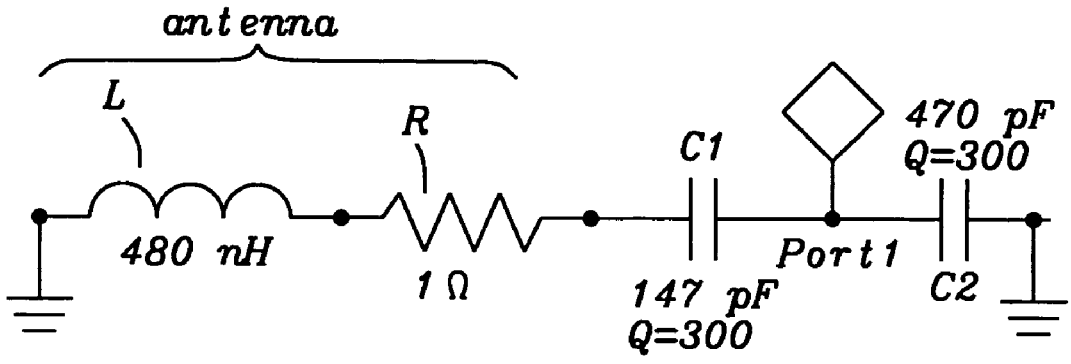
FIG. 1 – Prior Art
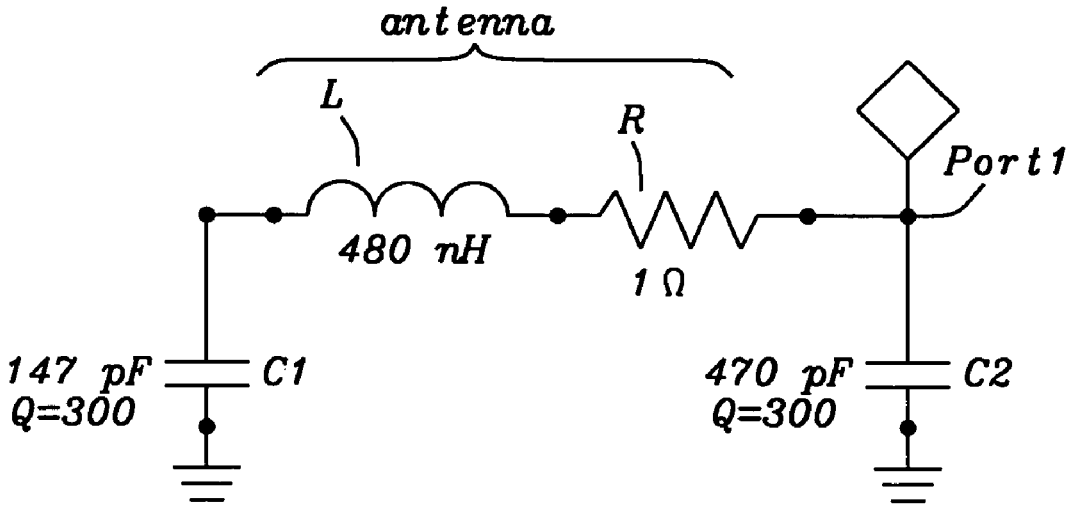
FIG. 2 – Prior Art

MULTI-BAND SMALL APERTURE ANTENNA

BACKGROUND OF THE INVENTION

1. Field of the Invention

The invention relates to circuits and methods of transforming a mono-band antenna into a multi-band antenna and more particularly to transforming a mono-band antenna by adding impedance matching circuits for two or more frequency bands which can range from a few megahertz to several hundred megahertz.

2. Description of the Related Art

At present small aperture antennas are being used in small size, short range wireless devices such as keyboards, mice, alarm systems and other similar devices. These devices are used for low frequencies extending from a few megahertz to several hundred megahertz. Such an antenna consists of a small size loop and a mono-band matching circuit. These loops are usually printed on a PCB (Printed Circuit Board) but they can also be made of wire. Recently, demand for multi-band operation has appeared. The reason is the need of interference avoidance and multi task applications. Separate antennas and/or PIN (positive-intrinsic-negative) diode switching are not good solutions because of the requirement for small size and low power consumption. The proposed multi-band antenna is ideal for such applications.

FIG. 1 shows a typical mono-band loop antenna. Inductance L and resistance R represent the antenna loop model, i.e. L and R model the antenna, where capacitor C1 sets the resonant frequency and capacitor C2 sets the matching impedance of the antenna. The diamond symbol indicates the signal input and is labeled Port 1. The numbers next to L, R, C1 and C2 are typical values for those network elements.

FIG. 2 is a variation of FIG. 1, where capacitor C1 is moved to the other side of the antenna and is grounded for better performance.

U.S. patents or U.S. patent application Publications which relate to the present invention are: U.S. Pat. No. 6,795,714 (Fickenscher et al.) discloses a multi-band antenna switch which can be used for switching between a branch and a receiving branch of a multi-band mobile radio telephone. This invention switches the transmitting and receiving branches of the mobile radio telephone so as to be differentiated from one another in time. U.S. Patent Application Publication 2006/0028332 (Miller) describes a multi-band antenna which is adapted to receive multiple RF signals. A multiplexer, comprising L-C resonant circuits attached to the antenna, separates and distributes the incoming frequencies to different users.

It should be noted that in the above-cited examples of the related art multiple frequencies are applied to multiple ports. None of the above-cited examples of the related art provide multiple frequencies applied to a single port. Accordingly, a new approach is desirable where multiple frequencies can be transmitted by a single antenna from a single port.

SUMMARY OF THE INVENTION

It is an object of at least one embodiment of the present invention to provide circuits and methods to create small size multi-band loop antennas.

It is another object of the present invention to transform mono-band antennas into multi-band antennas that are small and have a small aperture.

It is yet another object of the present invention to create impedance matching for two or more frequencies.

It is still another object of the present invention to create multi-band loop antennas usable for frequencies from a few megahertz to several hundred megahertz.

It is a further object of the present invention is to provide multi-band antennas without need of any switching to change the operating frequency.

These and many other objects have been achieved by adding matching circuits containing reactive elements such as capacitors and/or inductors to the antenna circuit, and by providing methods for tuning step by step these matching circuits to the desired frequencies.

These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIG. 1 is a basic matching circuit of a mono-band loop antenna of the prior art.

FIG. 2 is a circuit similar to FIG. 1 but slightly modified to provide better performance.

Use of the same reference number in different figures indicates similar or like elements.

DESCRIPTION OF THE PREFERRED EMBODIMENT

The present invention describes the design of a small multi-band loop antenna and the method of tuning it. The matching circuit contains additional reactance elements, such as capacitors and inductors. They transform a mono-band matching circuit into a multi-resonance matching structure and provide impedance matching for two or more frequency bands. These multi-band loop antennas can be used for frequencies extending from a few megahertz to several hundred megahertz. The number of components used, such as capacitors and inductors, depends on the number of resonant frequencies and their values depend on the size of the loop and required resonant frequencies and impedance. The more frequency bands that have to be covered the more complex becomes the matching circuit. The terms capacitive and inductive means may imply capacitors and inductors or any other devices capable of providing the function of a capacitor or inductor. Transistors or transistor circuits in integrated circuits (IC) also provide this function; they are cited by way of illustration and not of limitation, as applied to either capacitive or inductive means.

Figure 3:
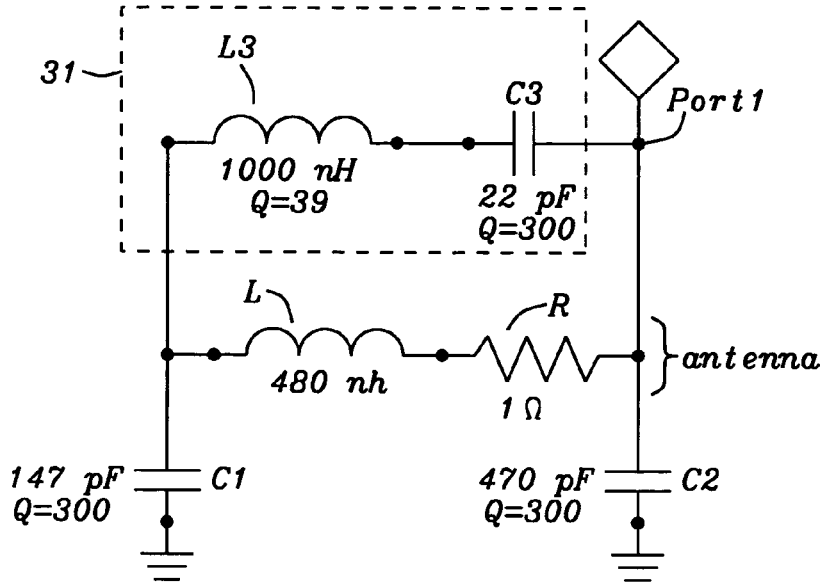
FIG. 3 is an example of a first preferred embodiment of the present invention of a matching circuit for a dual-band loop antenna.

We now describe a typical example of a first preferred embodiment of the dual-band antenna as illustrated in FIG. 3. The dual-band antenna FIG. 3 is a further development of FIG. 2. Inductor L3 and capacitor C3 form an additional series resonant circuit, creating a dual-band antenna. Coupled between Port1 and the junction of capacitor C1 and L, is the series resonant circuit 31 comprising capacitor C3 and inductor L3. The remaining circuit components were already described in FIG. 2. In this example L, R, C1 and C2 are first tuned to the middle frequency 38.487 MHz between the two required frequencies 27.1 MHz and 49.875 MHz (27.1+49.875)/2=38.487 MHz. Then C3=22 pF with a Q of 300 and L3=1000 nH with a Q of 39 is added and a dual resonant circuit is created. Now the lower resonant frequency is 27.1 MHz and the higher resonant frequency is 49.875 MHz. Circuit 31 (C3, L3) is series resonant at middle frequency (38.875 MHz), thus the circuit is capacitive at 27.1 MHz and inductive at 49.875 MHz. Therefore it is recommended to tune it to the higher frequency (49.875 MHz) by changing the L3 value and the lower frequency (27.1 MHz) by changing the C3 value.

Still referring to FIG. 3, we describe the method of tuning the dual-band antenna. The antenna first has to be tuned to the middle frequency (38.487 MHz) between the two desired frequencies without circuit 31 (L3 and C3) connected for approximately twice as big an impedance as required. C1 will tune for resonant frequency (38.487 MHz) and C2 for impedance matching. Next circuit 31 has to be connected. It has to be series resonant in the middle (38.487 MHz) between the two required frequencies. C3 has to be tuned precisely to the lower operating frequency (27.1 MHz) and the L3 inductor value will adjust the upper operating frequency (49.875 MHz). The impedance matching can be adjusted by changing the capacitor C2 value. Note that the middle frequency (38.487 MHz) is the parallel resonant frequency of L, R, C1 and C2 without C3, L3 and the series resonant frequency of C3, L3.

Figure 5:
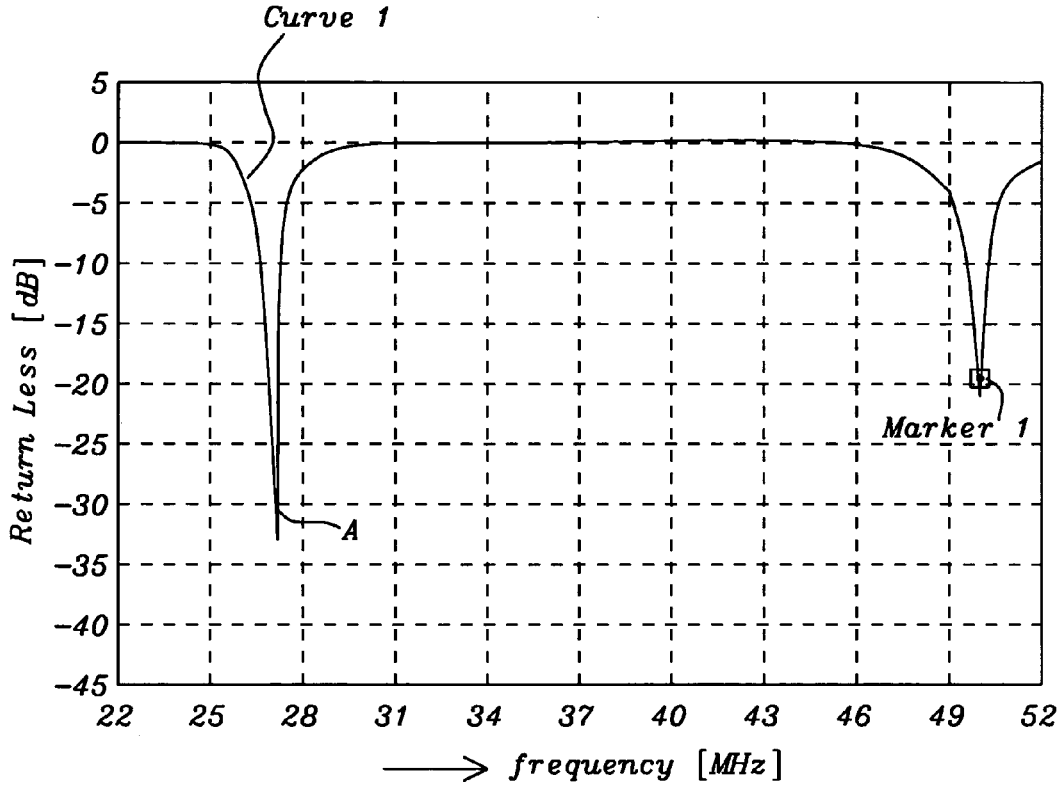
FIG. 5 is a Network Analyzer plot showing the Return Loss RL (S11) of the dual-band loop antenna of FIG. 3 at frequencies of 27.1 and 49.875 MHz.
Figure 6:
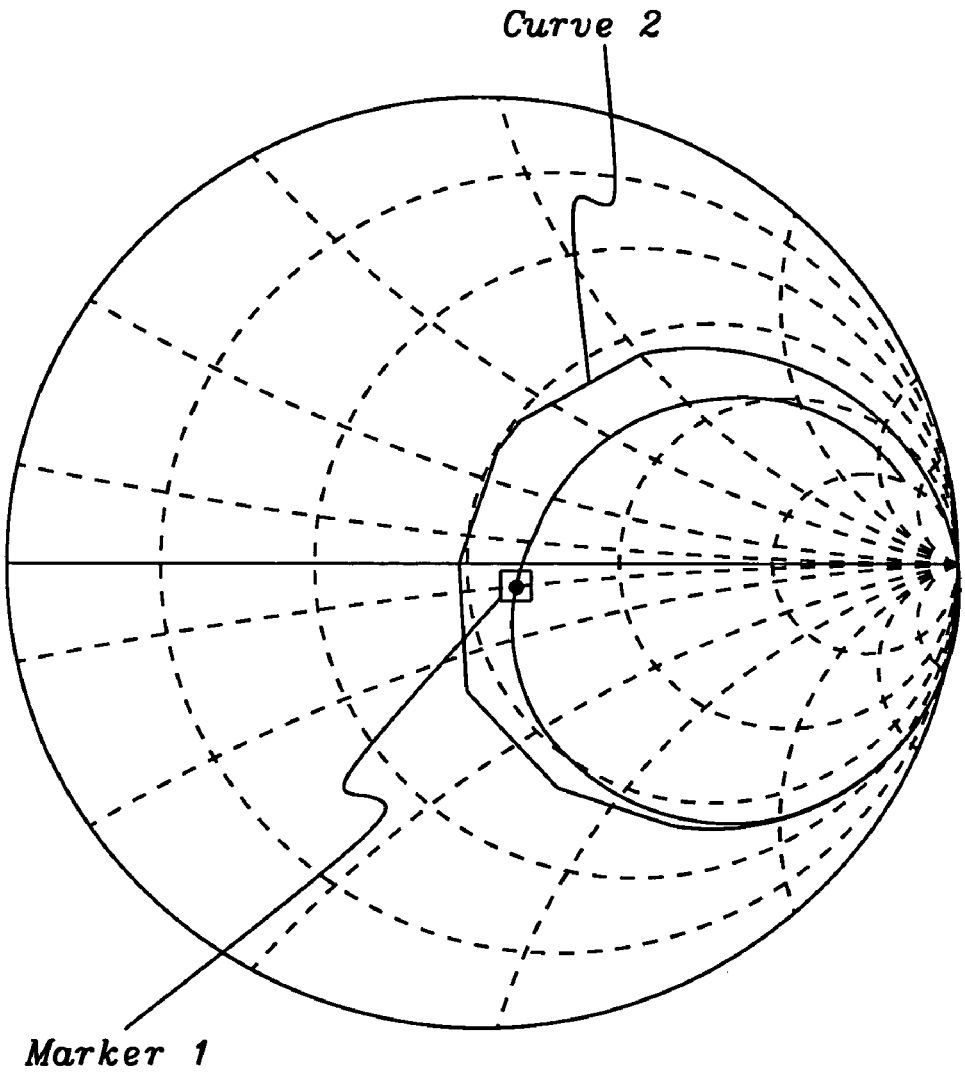
FIG. 6 is a Smith Chart graph of the complex impedance of the dual-band loop antenna of FIG. 3 at frequencies of 27.1 and 49.875 MHz.

FIG. 5 is a Network Analyzer plot (Curve 1) showing the Return Loss RL of the dual-band loop antenna of FIG. 3 at frequencies of 27.1 (Point A of Curve 1) and 49.875 MHz (Marker 1 of Curve 1). The RL at 27.1 MHz is about −30 dB and at 49.875 MHz is −19.6 dB. The y-axis is marked from −45 dB to +5 dB, the x-axis from 22 MHz to 52 MHz. FIG. 6 is a Smith Chart graph (Curve 2) and shows the complex impedance of the above described dual-band antenna of FIG. 3. Curve 2 illustrates a first Antenna impedance of about 49 Ohms at 27.1 MHz and at Marker 1 a second Antenna impedance of 55.783 Ohms−j9.835 Ohms at 49.875 MHz.

Figure 4:
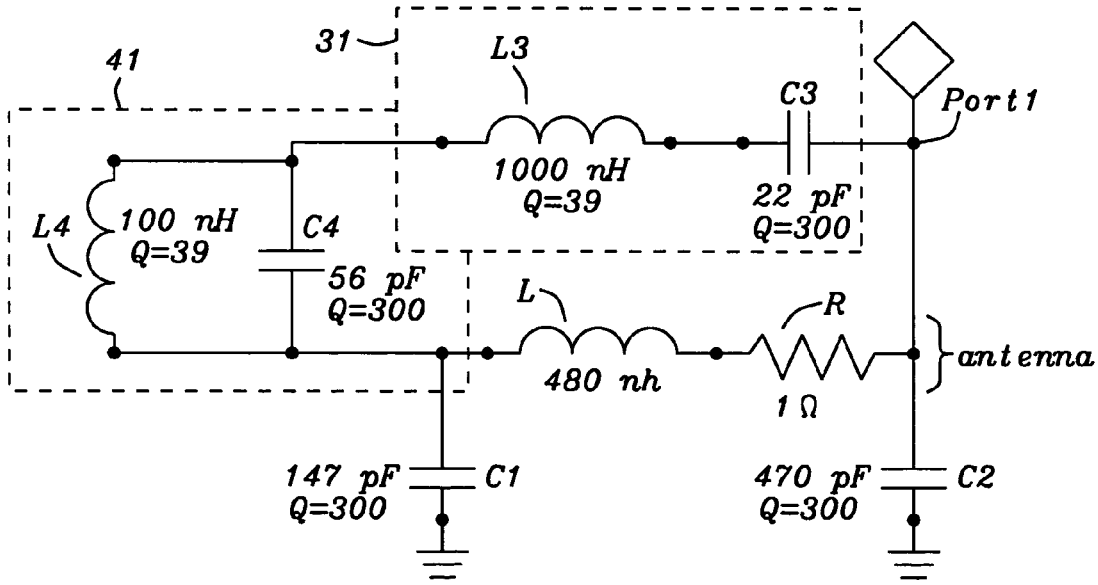
FIG. 4 is an example of a preferred embodiment of the present invention of a matching circuit for a tri-band loop antenna.

We now describe a typical example of the preferred embodiment of the tri-band antenna as illustrated in FIG. 4. The inventive circuit extends the above described dual-band antenna of FIG. 3 to a tri-band operation. A tri-band antenna can be created by inserting between L3 and the junction of C1 and L the parallel resonant circuit 41 comprising capacitor C4 and inductor L4. The remaining circuit components were already described in FIGS. 2 and 3. For the third frequency of 40.68 MHz a value for C4 is 56 pF with a Q of 300 and for L4 is 100 nH with a Q of 39. For those skilled in the art, it is understood that all values used in the above dual and tri-band antenna example are valid only for this particular case. They will have to be different if the antenna inductance L and/or antenna resistance R are different. They also have to be different for different frequencies.

Still referring to FIG. 4, we describe the method of tuning the tri-band antenna. First all steps for dual-band antenna tuning must be performed. Then the parallel resonant circuit 41 has to be added in series with the existing series resonant circuit 31. This will create the third resonant frequency, which has to be situated between the two other frequencies set before. As already mentioned above, C4 and L4 is the parallel resonant circuit 41. It will create the third resonant frequency in the antenna circuit. There is an infinite number of C4 and L4 values that will place the third resonance at the right frequency (40.68 MHz in the above example). Putting C4 and L4 into the circuit will change the other two frequencies and impedance, so it is necessary to find such a set of C4, L4 values which will make the smallest possible change. It is not easy to calculate by hand the values of C4 and L4, because of great number of reactive components. In practice it is recommended to use one of the computer simulation programs such as ADS, Eagleware or Ansoft to find the required values.

To start one needs to known the antenna inductance L, antenna resistance R and the required three operating frequencies. L and R can be measured with a Network Analyzer at the middle frequency, which is 38.487 MHz in the present example. Once one knows the L and R values (antenna model), they are put into the Simulation Program and one finds the C1 and C2 values that will give the required impedance at the selected middle frequency. Then one adds C3 and L3 and finds the right values to obtain the right impedance at the lower and upper operating frequency (27.1 and 49.875 MHz). One has to adjust the existing C1 and C2 values as well. Now the right values for the dual band antenna have been obtained. Once done, one adds C4 and L4 to the circuit and finds the right values to get the third resonant frequency (40.68 MHz in the present example). One also has to adjust C1 and C2 for the required impedance. Now one can put the simulated values into the real circuit and measure impedance and Return Loss RL (S11). Some small adjustment may be necessary due to component tolerance and antenna measurement accuracy.

Figure 7:
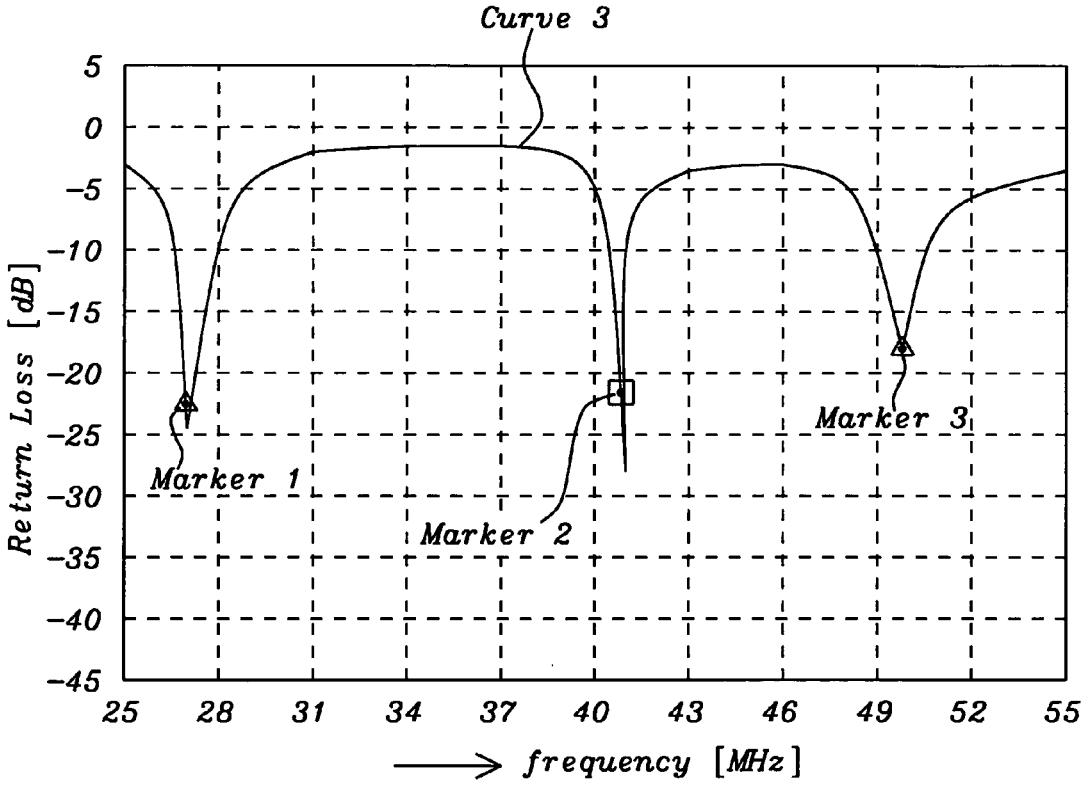
FIG. 7 is a Network Analyzer plot showing the Return Loss RL (S11) of the tri-band loop antenna of FIG. 4 at frequencies of 27.075, 40.7, and 49.85 MHz
Figure 8:
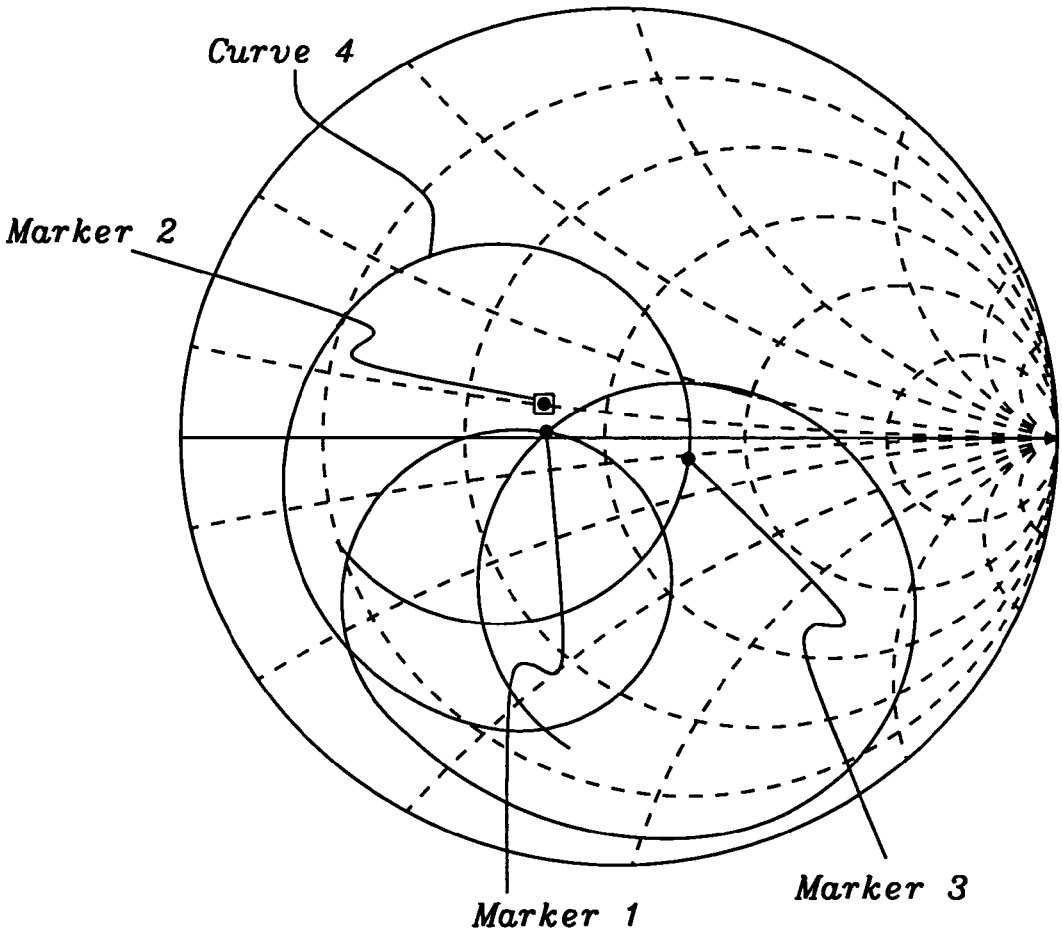
FIG. 8 is a Smith Chart graph of the complex impedance of the tri-band loop antenna of FIG. 4 at frequencies of 27.075, 40.7, and 49.85 MHz.
Figure 9:
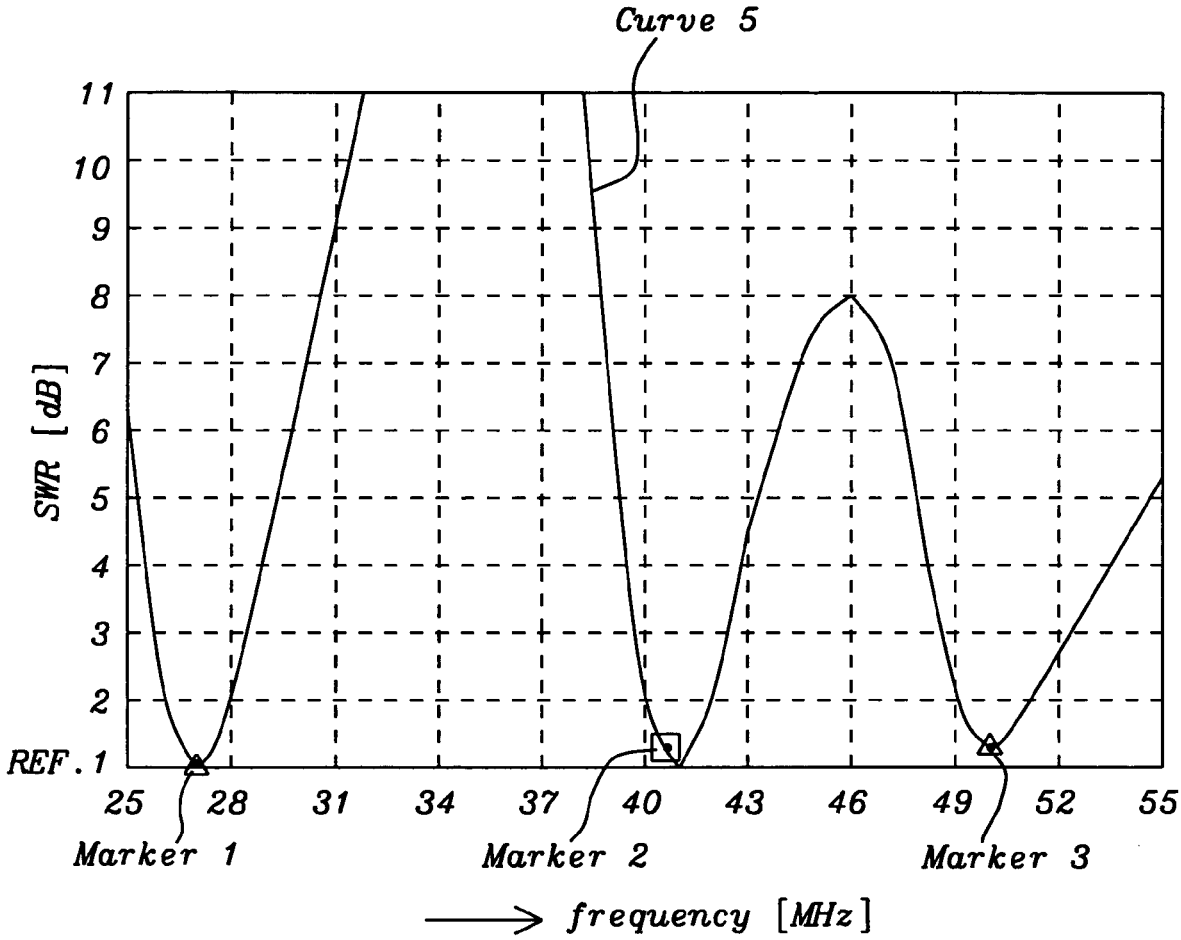
FIG. 9 is a plot showing the Standing Wave Ratio (SWR) of the tri-band loop antenna of FIG. 4 at frequencies of 27.075, 40.7, and 49.85 MHz.

FIG. 7 is a Network Analyzer plot (Curve 3) showing the Return Loss RL of the tri-band loop antenna of FIG. 4 at frequencies of 27.075 (Marker 1 of Curve 3), 40.7 (Marker 2 of Curve 3), and 49.85 MHz (Marker 3 of Curve 3). The RL at 27.075 MHz is −21.405 dB, at 40.7 MHz is −22.763 dB, and at 49.85 MHz is −16.813 dB. The y-axis is marked from −45 dB dB to +5, the x-axis from 25 MHz to 55 MHz. FIG. 8 is a Smith Chart graph (Curve 4) and shows the complex impedance of the above described tri-band antenna of FIG. 4. Curve 4 describes the antenna impedance which is 42.553 Ohms+j 1.939 Ohms at 27.075 MHz (Marker 1 of Curve 4), 42.695 Ohms+j 1.138 Ohms at 40.7 MHz (Marker 2 of Curve 4), and 66.054 Ohms−j3.553 Ohms at 49.85 MHz (Marker 3 of Curve 4). FIG. 9 is a plot (Curve 5) showing the Standing Wave Ratio (SWR) of the tri-band loop antenna of FIG. 4 at frequencies of 27.075 MHz and 1.192 (Marker 1 of Curve 5), 40.7 MHz and 1.178 (Marker 2 of Curve 5), and 49.85 MHz and 1.338 (Marker 3 of Curve 5). The y-axis is marked from 1 dB, the reference point, to 11 dB. The x-axis is marked from 25 MHz to 55 MHz.

It is understood by those skilled in the art that it is possible to arrange dual and tri-band antennas in different topologies without differing from the scope of the invention. Described next are some possible variations of these topologies, by way of illustration and not of limitation, as applied to those topologies.

In a second preferred embodiment of the present invention of a dual band antenna, in a modification from FIG. 3, the series circuit 31 C3, L3 connection parallel to L, R is changed into a parallel C3, L3 resonant circuit connected in series between C1 and L.

In a second preferred embodiment of the present invention of a tri-band antenna, in a modification from FIG. 4, the original series combination of the L3, C3 series resonant circuit 31 in series with the L4, C4 parallel resonant circuit 41 is changed into a parallel connection of the L3, C3 series resonant circuit with the parallel L4, C4 resonant circuit, i.e., both circuits 31 and 41 are coupled in parallel between Port1 and the junction of C1 and L.

In a third preferred embodiment of the present invention of a tri-band antenna, in a modification from FIG. 4, the L3, C3 series resonant circuit 31 is converted into a parallel resonant circuit and L4, C4 is changed into a series resonant circuit, i.e., both circuits are coupled in series between Port1 and the junction of C1 and L.

In a fourth preferred embodiment of the present invention of a tri-band antenna, in a modification from FIG. 4, the L3, C3 series resonant circuit 31 is converted into a parallel resonant circuit and L4, C4 is changed into a series resonant circuit, i.e., both circuits are coupled in parallel between Port1 and the junction of C1 and L.

Regardless of the topology, the antenna tuning procedure remains the same, because each added circuit has a particular function. The tuning still has to be done step by step because of the significant number of LC components.

Elements previously discussed are indicated by like numerals and need not be described further.

In the illustrated embodiments, the process of the invention is shown, by way of illustration and not of limitation, as applied either to the selection of the frequencies, the component values or the topologies.

While the invention has been particularly shown and described with reference to the preferred embodiments thereof, it will be understood by those skilled in the art that various changes in form and details may be made without departing from the spirit and scope of the invention.

What is claimed is:

1. A dual-band loop antenna, comprising:

a dual-band antenna comprising resistive and inductive components, said antenna coupled at one end to an input port and at the other end in communication with a node N, said input port providing electrical energy to cause said antenna to radiate at a middle frequency, said dual-band antenna providing impedance matching for two frequencies; and a matching circuit, comprising inductive and capacitive means, in communication with said antenna, where said matching circuit causes said antenna to radiate at a first frequency above said middle frequency and at a second frequency below said middle frequency, where said antenna is capable of operating at said first and said second frequencies, and where said first and said second frequencies are applied to said input port.

2. The dual-band loop antenna of claim 1, wherein a first capacitive means is coupled between said node N and a reference potential and where a second capacitive means is coupled between said input port and a reference potential.

3. The dual-band loop antenna of claim 2, wherein said antenna is tuned to said middle frequency by adjusting said first capacitive means.

4. The dual-band loop antenna of claim 1, wherein said second capacitive means is adjusted for impedance matching.

5. The dual-band loop antenna of claim 1, wherein said inductive means of said matching circuit is adjusted to tune to said first frequency.

6. The dual-band loop antenna of claim 1, wherein said capacitive means of said matching circuit is adjusted to tune to said second frequency.

7. The dual-band loop antenna of claim 1, wherein said inductive and capacitive means of said matching circuit are arranged in series, and where said matching circuit is coupled between said input port and said node N.

8. The dual-band loop antenna of claim 1, wherein said inductive and capacitive means of said matching circuit are arranged in parallel, and where said matching circuit is coupled in series between said other end of said antenna and said node N.

9. A tri-band loop antenna, comprising:

a tri-band antenna comprising resistive and inductive components, said antenna coupled at one end to an input port and at the other end in communication with a node N, said input port providing electrical energy to cause said antenna to radiate at a middle frequency;

a first matching circuit, comprising inductive and capacitive means, in communication with said antenna, where said first matching circuit causes said antenna to radiate at a first frequency above said middle frequency and at a second frequency below said middle frequency; and a second matching circuit, comprising inductive and capacitive means, in communication with said antenna, where said second matching circuit causes said antenna to radiate at a third frequency, where said third frequency is between said middle and said first frequency, and where said antenna is capable of operating at said first, said second, and said third frequencies.

10. The tri-band loop antenna of claim 9, wherein a first capacitive means is coupled between said node N and a reference potential, and where a second capacitive means is coupled between said input port and said reference potential.

11. The tri-band loop antenna of claim 10, wherein said antenna is tuned to said middle frequency by adjusting said first capacitive means.

12. The tri-band loop antenna of claim 10, wherein said second capacitive means is adjusted for impedance matching.

13. The tri-band loop antenna of claim 9, wherein said inductive means of said first matching circuit is adjusted to tune to said first frequency.

14. The tri-band loop antenna of claim 9, wherein said capacitive means of said first matching circuit is adjusted to tune to said second frequency.

15. The tri-band loop antenna of claim 9, wherein said inductive and capacitive means of said first matching circuit are arranged in series, where said inductive and capacitive means of said second matching circuit are arranged in parallel, and where said first and said second matching circuit arranged serially are coupled between said input port and said node N.

16. The tri-band loop antenna of claim 9, wherein said inductive and capacitive means of said first matching circuit are arranged in series, where said inductive and capacitive means of said second matching circuit are arranged in parallel, and where said first and said second matching circuit arranged in parallel are coupled between said input port and said node N.

17. The tri-band loop antenna of claim 9, wherein said inductive and capacitive means of said first matching circuit are arranged in parallel, where said inductive and capacitive means of said second matching circuit are arranged in series, and where said first and said second matching circuit arranged serially are coupled between said input port and said node N.

18. The tri-band loop antenna of claim 9, wherein said inductive and capacitive means of said first matching circuit are arranged in parallel, where said inductive and capacitive means of said second matching circuit are arranged in series and where said first and said second matching circuit arranged in parallel are coupled between said input port and said node N.

19. The method of transforming a mono-band antenna into a dual-band antenna, comprising the steps of:

a) providing an antenna where either end is coupled to a reference potential via a first and a second capacitive means;

b) tuning said antenna to a middle frequency between two desired frequencies by adjusting said first capacitive means for resonant frequency;

c) coupling a matching circuit, comprising inductive and capacitive means, to said antenna, where said matching circuit is series resonant at said middle frequency, thereby converting said antenna into a dual-band antenna;

d) adjusting said inductive means of said matching circuit to tune to the higher of said two desired frequencies;

e) adjusting said capacitive means of said matching circuit to tune to the lower of said two desired frequencies; and f) adjusting said second capacitive means for impedance matching.

20. The method of claim 19, wherein said matching circuit comprises serially coupled inductive and capacitive means, said matching circuit coupled across said antenna.

21. The method of claim 19, wherein said matching circuit comprises parallel coupled inductive and capacitive means, said matching circuit coupled in series with said antenna.

22. The method of transforming a mono-band antenna into a tri-band antenna, comprising the steps of:

a) providing an antenna where either end is coupled to a reference potential via a first and a second capacitive means;

b) tuning said antenna to a middle frequency between two desired frequencies by adjusting said first capacitive means for resonant frequency;

c) coupling a first matching circuit, comprising serially coupled inductive and capacitive means, to said antenna, where said first matching circuit is series resonant at said middle frequency, thereby converting said antenna into a dual-band antenna;

d) adjusting said inductive means of said first matching circuit to tune to said higher of said two desired frequencies;

e) adjusting said capacitive means of said first matching circuit to tune to the lower of said two desired frequencies;

f) adjusting said second capacitive means for impedance matching;

g) coupling a second matching circuit, comprising inductive and capacitive means in parallel, to said antenna;

h) adjusting said capacitive and inductive means of said second matching circuit, arriving thereby at a desired third frequency;

i) adjusting said first capacitive means to fine tune said desired third frequency; and j) adjusting said second capacitive means for impedance matching.

23. The method of claim 22, wherein third frequency is located between said middle and said higher frequency.

24. The method of claim 22, wherein said first and said second matching circuits are serially coupled across said antenna.

25. The method of claim 22, wherein said first and said second matching circuits are coupled in parallel across said antenna.

* * * * *

UNITED STATES PATENT AND TRADEMARK OFFICE

CERTIFICATE OF CORRECTION

PATENT NO. : 7,602,345 B2
APPLICATION NO. : 11/514591
DATED : October 13, 2009
INVENTOR(S) : Michael Chominski It is certified that error appears in the above-identified patent and that said Letters Patent is hereby corrected as shown below:

Title Page Assignee, item (73), delete Assignee, "Free Alliance SDN BHD, Sri Hartmas, (MY)" and replace with -- Free Alliance Sdn Bhd, Kuala Lumpur (MY) --.

Signed and Sealed this

Twenty-third Day of February, 2010

David J. Kappos

David J. Kappos
*Director of the United States Patent and Trademark Office*